US006736662B2

(12) United States Patent
Lin

(10) Patent No.: US 6,736,662 B2
(45) Date of Patent: May 18, 2004

(54) POWER CONNECTOR

(75) Inventor: Nick Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/192,120

(22) Filed: Jul. 9, 2002

(65) Prior Publication Data

US 2003/0216078 A1 Nov. 20, 2003

(30) Foreign Application Priority Data

May 17, 2002 (TW) ..... 91207047 U

(51) Int. Cl.[7] ..... H01R 13/62
(52) U.S. Cl. ..... 439/350; 439/352
(58) Field of Search ..... 439/350–358

(56) References Cited

U.S. PATENT DOCUMENTS 5,192,225 A * 3/1993 Suzuki ..... 439/489
5,338,219 A * 8/1994 Hiramoto et al. ..... 439/350
5,348,493 A * 9/1994 Power ..... 439/352
5,380,217 A * 1/1995 Yagi et al. ..... 439/358
5,692,923 A * 12/1997 Sawada ..... 439/555
6,095,844 A * 8/2000 Kasai ..... 439/352
6,159,033 A * 12/2000 Oka ..... 439/350
6,171,130 B1 * 1/2001 Yoshida et al. ..... 439/352
6,290,514 B1 * 9/2001 McHugh et al. ..... 439/108

* cited by examiner

*Primary Examiner*—Gary F Paumen
(74) *Attorney, Agent, or Firm*—Wei Te Chung

(57) ABSTRACT

A power connector (1) for delivering power and signals includes an insulative housing (10), a contact module (20), a capacitor board (30) and a signal board (40), the capacitor and signal boards respectively being connected to a rear portion of the contact module. The housing defines a top wall (18), opposite side walls (17) and a chamber (12) for receiving the contact module. The contact module includes a number of contacts (221, 222, 223, 224) and an insulative member having a number of insulative components (211, 212, 213) for clamping the contacts. A locking device consisting of protrusions (24) and receiving holes (15) respectively formed on an upper surface of the insulative member and the top wall of the housing is provided to securely assemble the contact module to the housing.

8 Claims, 4 Drawing Sheets

POWER CONNECTOR

CROSS REFERENCE TO RELATED APPLICATION

This application relates to U.S. Pat. No. 6,290,514 issued on Sep. 18, 2001 and assigned to the same assignee as the present invention. The entire disclosure of this patent is incorporated herein by reference.

BACKGROUND OF THE INVENTION

1. Field of the Invention

The present invention relates to a power connector, and more particularly to a power connector having a reliable connection between a contact module and an insulative housing thereof.

2. Description of the Related Art

Microprocessors are often assembled to a printed circuit board together with IC components (such as a cache) to form an IC module, and then a power connector is required to transmit power from a power supply to the IC module. Such a power connector, as disclosed in U.S. Pat. No. 6,290,514, is greatly different from a common connector. FIG. 4 of the attached drawings shows such a power connector comprising an insulative housing 6 and a contact module 7 which can be received in the housing 6. A pair of latches 71 respectively defining a pair of projections 711 at free ends thereof on lateral sides of the contact module 7 are designed to engage with a pair of hooks 61 formed proximate to side walls of the housing 6 to prevent relative movement between the housing 6 and the contact module 7. However, because there are a large number of contacts in the contact module 7, thus a large force is required to completely insert an IC module (not shown) into the housing 6 in order to form a reliable electrical connection. While the engagement between the contact module 7 and the housing 6 is only accomplished by the side hooks 61 and latches 71, a middle portion of the contact module 7 will most probably be deformed during the insertion of the IC module for lacking of fixation. This in turn may cause the engagement between the hooks 61 and the latches 71 to become disabled, and further make it failure to transmit power and signals.

Hence, it is necessary to design a power connector having reliable connection between a contact module and an insulative housing thereof to overcome the disadvantages of the related art.

SUMMARY OF THE INVENTION

Accordingly, it is an object of the present invention to provide a power connector having reliable connection between a contact module and an insulative housing thereof.

To achieve the above object, a power connector for delivering power and signals from a power supply and a signal source to an IC module comprises an insulative housing, a contact module receivable in the housing, a capacitor board and a signal board respectively connected to a rear portion of the contact module for delivering power and signals. The housing defines a top wall, opposite side walls and a chamber therein for receiving the contact module. The contact module comprises a plurality of contacts and insulative components to clamp the contacts. A pair of latches is formed on the contact module with a pair of projections on lateral side surfaces at free ends thereof to engage with a pair of hooks formed proximate to side walls of the housing. Moreover, a locking device is provided to securely locate the contact module in the chamber of the housing which locking device consists of a receiving hole and a protrusion respectively formed on the top wall of the housing and on an upper surface of the contact module.

Other objects, advantages and novel features of the invention will become more apparent from the following detailed description of the preferred embodiment thereof when taken in conjunction with the accompanying drawings, wherein:

DETAILED DESCRIPTION OF THE INVENTION

Figure 1:
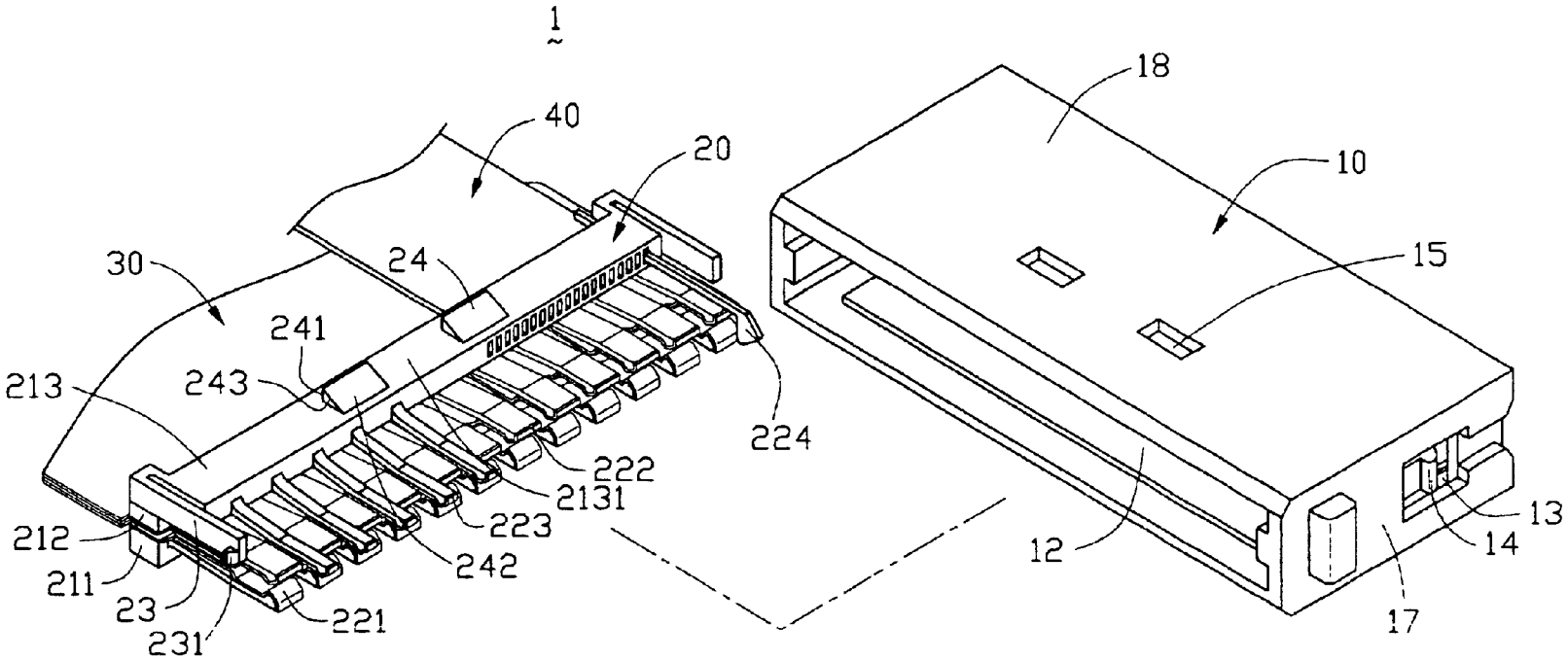
FIG. 1 is a partially disassembled, perspective view of a power connector in accordance with a first embodiment of the present invention.
Figure 2:
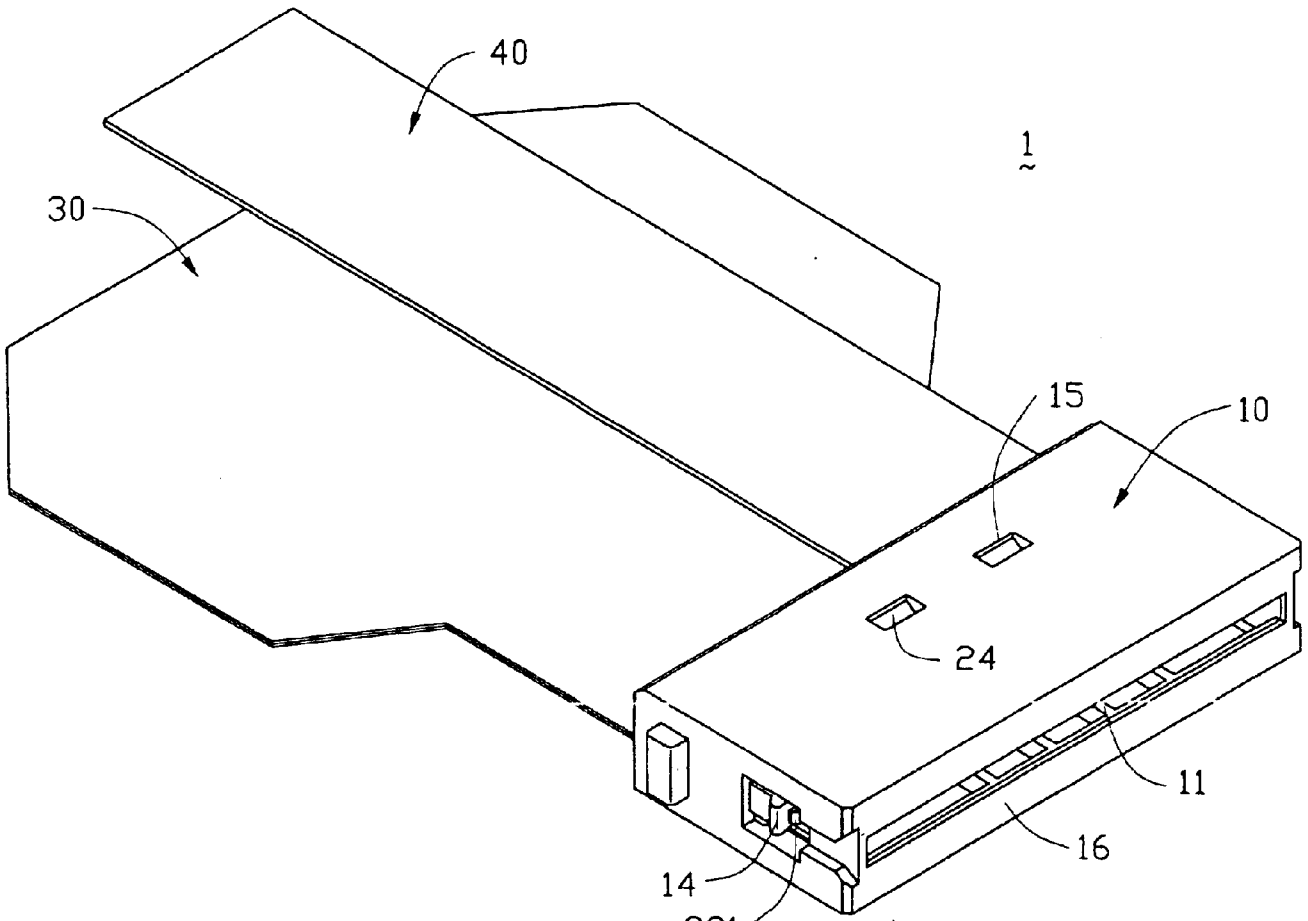
FIG. 2 is an assembled view of the power connector of FIG. 1.

Referring to FIGS. 1 and 2, a power connector 1 for transmitting power and signals from a power supply (not shown) and a signal source (not shown) to an IC module (not shown) in accordance with a first embodiment of the present invention comprises an insulative housing 10, a contact module 20, a capacitor board 30 and a signal board 40. The insulative housing 10 is rectangular in sharp and has a front wall 16, a top wall 18 and opposite side walls 17. A slot 11 (FIG. 2) is defined along the front wall 16 and extends inwardly to communicate with a chamber 12. A pair of openings 13 associating with a pair of hooks 14 outwardly extending therefrom is defined in the side walls 17 adjacent to the front wall 16 of the housing 10.

The contact module 20 comprises an insulative member including a bottom, a middle and a top insulative components 211, 212 and 213 arranged in a stack, and a plurality of contacts including a plurality of ground contacts 221, a plurality of processor power contacts 222, a plurality of cache power contacts 223 and a plurality of individual signal contacts 224 (only one shown), which are respectively clamped by corresponding insulative components 211, 212 and 213. A front end of the capacitor board 30 is disposed between the bottom and middle insulative components 211 and 212, and a rear end of the capacitor board 30 extends rearwardly for connecting to power and grounding lines of the power supply. The signal board 40, such as a flexible printed board, has opposite front and rear ends respectively connected with the signal contacts 224 and the signal source via a signal connector (not shown). The assembly of the capacitor board 30 and the signal board 40 to the contact module 20 is disclosed in U.S. Pat. No. 6,290,514, which is incorporated herein by reference.

A pair of latches 23 with a pair of projections 231 formed thereon to engage with the hooks 14 of the housing 10 is formed on opposite ends of the top insulative component 213 of the contact module 20. A locking device comprises a pair of protrusions 24 protruding from an upper surface 2131 of the top insulative component 213, and a pair of receiving holes 15 formed in the top wall 18 of the housing 10 to receive the protrusions 24 when the contact module 20 is inserted into the chamber 12 of the housing 10 and to further fix the contact module 20 in the housing 10. A cross section of each protrusion 24 is triangular. Each protrusion 24 comprises a vertical face 241 perpendicular to a direction of the contact module 20 inserting into the chamber 12 of the housing 10, a horizontal face (not shown) parallel to the upper surface 2131 of the top insulative component 213, an inclined guide face 242 adjacent to the vertical face 241 and opposite side faces 243.

In assembly, the capacitor board 30 and the signal board 40 are respectively connected to the contact module 20, the contact module 20 together with the boards 30, 40 is then inserted into the chamber 12 of the insulative housing 10 until the protrusions 24 of the contact module 20 are engaged with the receiving holes 15 of the housing 10, and the projections 231 of the latches 23 of the top insulative component 213 are engaged with the hooks 14 of the housing 10. By this means, the contact module 20 is firmly assembled to the housing 10.

Figure 3:
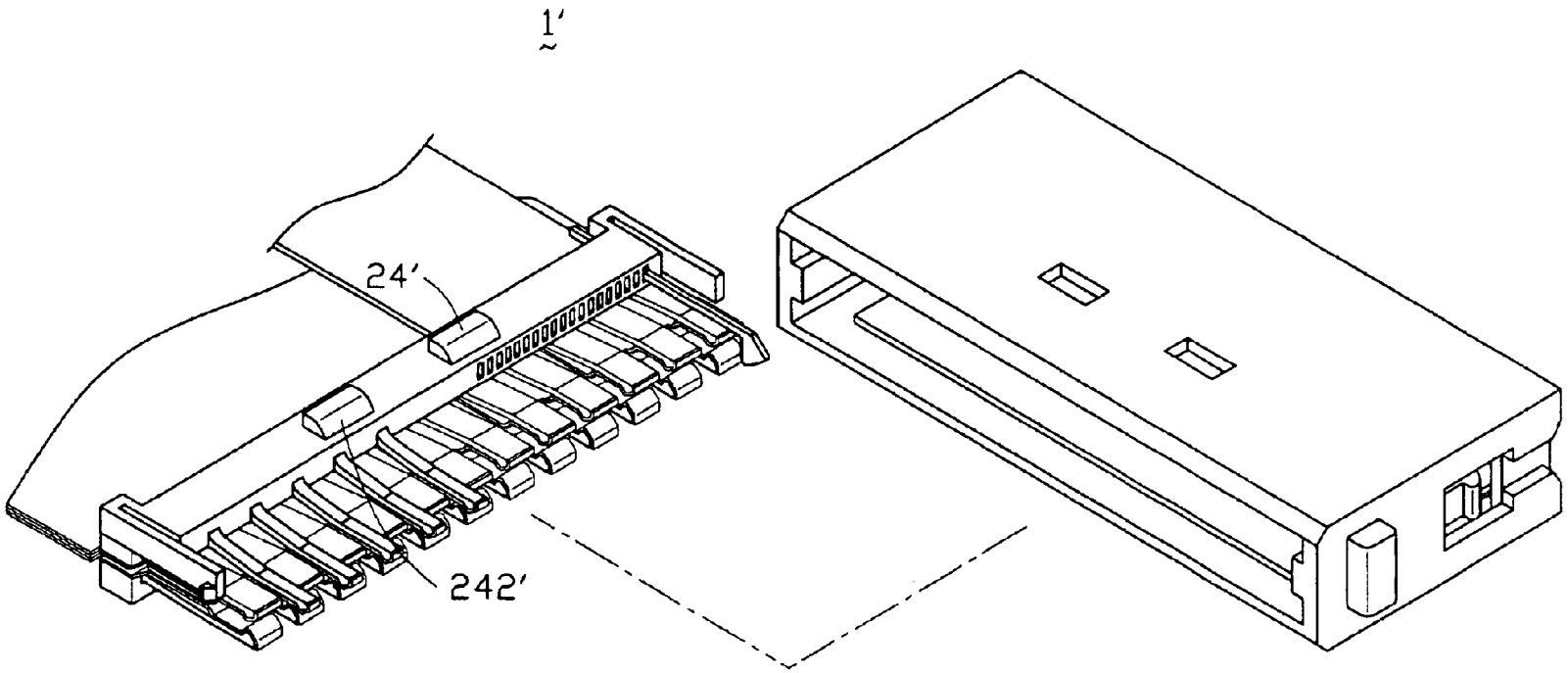
FIG. 3 is a partially disassembled, perspective view of a power connector in accordance with a second embodiment of the present invention.
Figure 4:
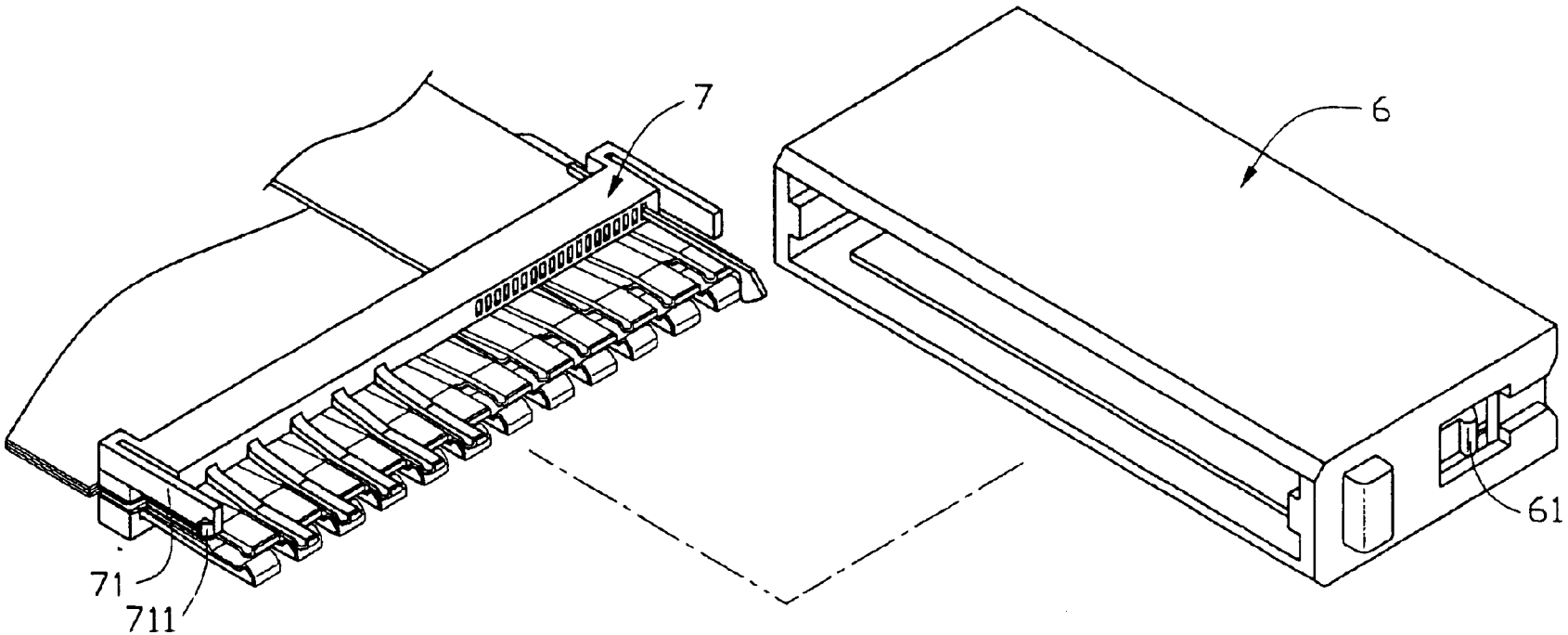
FIG. 4 (RELATED ART)
FIG. 4 is a partially disassembled, perspective view of a related power connector.

FIG. 3 shows an alternative protrusion 24' of the contact module 20. The protrusion 24' is, in general, similar to the protrusion 24 discussed above with reference to FIGS. 1–2 with only the inclined guide face 242 replaced by an arcuate guide face 242' which can also be received in the receiving hole 15 of the housing 10 and performs the same function. A cross section of the protrusion 24' is fan-shaped.

It should be noted that the protrusions 24 and the receiving holes 15 may be reversed in position with each other, i.e. the protrusion 24 may be formed on an inner side of the top wall 18 of the insulative housing 10 and the receiving hole 15 may be correspondingly defined in the upper surface 2131 of the top insulative component 213. Other components of the connector 1 are the same as foregoingly disclosed with reference to FIGS. 1–2 or FIG. 3.

It is to be understood, however, that even though characteristics and advantages of the present invention have been set forth in the foregoing description, together with details of the structure and function of the preferred embodiment of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for delivering power and signals from a power supply and signal source comprising:

an insulative housing having a top wall, a pair of opposite side walls and a chamber therein;

a contact module receivable in the chamber of the insulative housing, comprising a plurality of contacts and an insulative member having a plurality of insulative components to clamp the contacts; wherein the insulative housing comprises a pair of hooks outwardly extending from the side walls, and the contact module comprises a pair of latches engaging with corresponding hooks; and a locking device formed between the insulative housing and the contact module comprises a plurality of receiving holes and corresponding protrusions having triangular cross section received in the receiving holes.

2. The electrical connector as claimed in claim 1, wherein the receiving holes of the locking device are defined in the top wall of the insulative housing, and the protrusions are formed on an upper surface of the insulative member of the contact module.

3. The electrical connector as claimed in claim 2, wherein each protrusion comprises a vertical face perpendicular to a direction of the contact module inserting into the chamber of the housing, a horizontal face parallel to the upper surface of the top insulative component, and an inclined guide face adjacent to the vertical face and opposite side faces.

4. An electrical connector for delivering power and signals from a power supply and a signal source comprising:

an insulative housing having a top wall, a pair of opposite side walls with a pair of hooks outwardly extending therefrom, a front wall with a slot defined therein, a chamber inwardly extending from the slot, and a plurality of receiving holes defined in the top wall;

a contact module receivable in the chamber of the insulative housing and comprising a plurality of contacts and an insulative member comprising a plurality of insulative components to clamp the contacts, and a pair of latches engagable with corresponding hooks of the side walls; and a plurality of protrusions having fan-shaped cross section formed on an upper surface of the insulative member which protrusions are engagable with corresponding receiving holes of the insulative housing.

5. The electrical connector as claimed in claim 4, wherein each protrusion comprising a vertical face perpendicular to a direction of the contact module inserting into the chamber of the housing, a horizontal face parallel to the upper surface of the top insulative component, and an inclined guide face adjacent to the vertical face and opposite side faces.

6. The electrical connector as claimed in claim 5, wherein the guide face is arcuate.

7. An electrical connector comprising;

an insulative housing including two opposite top and bottom walls and two opposite side walls, commonly defining an elongated chamber therein;

each of said side walls defining a latching section thereof;

a contact module received in the chamber, said contact module including an insulative member holding a plurality of signal and power contacts thereto;

said insulative member including a pair of a pair of resilient latches, at two opposite lengthwise ends, latchably engaged within the corresponding latching sections, respectively, interlocking means formed at middle portions of said housing and said insulative member along an elongated direction of said chamber so as to provide support around said middle portion of said insulative member; and said interlocking means including a pair of receiving holes in the top wall, and a pair of protrusions formed the middle portion of a top face of the insulative member and received in the receiving holes, respectively, the middle portion of the top face of the insulative member being not resiliently moveable relative to the insulative member; wherein each of said protrusions is fully horizontally circumferentially and compactly surrounded in the corresponding receiving hole with thereof only a guide face upwardly exposed to an exterior vertically.

8. The electrical connector as claimed in claim 7, wherein said latches define laterally extending hooks while said interlocking means defines at least one vertically extending hook.

* * * * *